United States Patent [19]

Angell

[11] 4,030,603

[45] June 21, 1977

[54] PROTECTIVE PACKAGE AND METHOD THEREFOR

[75] Inventor: Robert L. Angell, Glendora, Calif.

[73] Assignee: Angell and Associates, Ontario, Calif.

[22] Filed: June 18, 1975

[21] Appl. No.: 588,088

Related U.S. Application Data

[63] Continuation of Ser. No. 370,801, June 18, 1973, abandoned.

[52] U.S. Cl. ..... 206/521; 206/497; 206/499; 53/305

[51] Int. Cl.² ..... B65D 81/02; B65D 81/14; B65D 65/44

[58] Field of Search ..... 206/461, 497, 499, 500, 206/521; 53/305

[56] References Cited

UNITED STATES PATENTS

| | | | |
|---|---|---|---|
| 3,181,699 | 5/1965 | Armentrout | 206/461 |
| 3,215,266 | 11/1965 | Dreyfuss | 206/497 |
| 3,353,326 | 11/1967 | Becker | 206/497 |

*Primary Examiner*—William Price
*Assistant Examiner*—Douglas B. Farrow
*Attorney, Agent, or Firm*—Nilsson, Robbins, Dalgarn & Berliner

[57] ABSTRACT

An improved method for packaging fragile or sensitive articles resulting in a package in a container which protects the articles during handling, shipping or storage. A heat treat-shrinkable wrapping provided with at least one air exit aperture covers a frame within which a fragile article is suspended. After heat treat-shrinking the wrapping, the package containing the fragile article and the frame is placed in a suitable shipping container of sufficient size to firmly hold the package therein.

7 Claims, 4 Drawing Figures

PROTECTIVE PACKAGE AND METHOD THEREFOR

This is a continuation of application Ser. No. 370,801, filed June 18, 1973 now abandoned.

BACKGROUND OF THE INVENTION

The present invention relates to a simple and inexpensive method for making shock-resistant packages for fragile or sensitive articles in order to protect such articles during handling, shipping or storage. When housed in a suitable container, a package made in accordance with the present invention substantially neutralizes any direct shock transfer to a fragile article therein.

In the prior art, various cushioning materials and cushioning devices have been used in attempts to protect fragile articles in packages and containers from shocks and/or vibrations usually experienced during handling and shipment. There are many cushioning materials available for use which can be categorized by major groups. The cellular group includes such materials as cork and wood which have moderate resilience, and highly resilient materials such as natural and synthetic elastomers which include foam rubber, latex foam and expanded polystyrene, for example. The mated fiber group includes many materials in the cellulosic sub-group such as straw, paper and excelsior. Also included in the matted fiber group are inorganic materials such as glass fiber pads and materials of animal origin such as felt and curled hair. Granular materials form another group and include popcorn and sawdust, for example. One more major group comprises ridged, creped, corrugated or molded materials of which single-face corrugated fiberboard is very popular.

When the above prior art cushioning materials do not provide the proper protection for fragile, sensitive articles or are not economical, then the usual practice has been to use special cushioning systems. These systems include tension spring mountings, suspension mountings, and shock and shear mounts. Tension spring arrangements do not always function with linear characteristics and vibration isolation is often an extreme problem. In suspension systems, canvas straps are widely used to float an article to be protected but, in most cases, only about half of the straps being used will carry the load. Although shock and shear mounts have been widely employed to minimize shock damage, it has been often necessary to provide damping systems to damp out natural vibration frequencies encountered during shipment. Additionally, some other prior art protective containers and packaging methods are shown and described in U.S. Pat. Nos. 2,771,184; 2,811,246; 3,038,593; 3,136,413 and 3,700,097; and Australian Pat. No. 265,973.

SUMMARY OF THE INVENTION

The improved method of the present invention includes suspending a fragile or sensitive article in a frame, enclosing the entire frame and article in a shrinkable material, and shrinking the shrinkable material around the frame and article to form a firm-fitting cover or enclosure thereabout. Thereafter, the thus-formed package is enclosed in a suitable shipping container where the package is firmly retained.

DESCRIPTION OF THE PREFERRED EMBODIMENT

Figure 1:
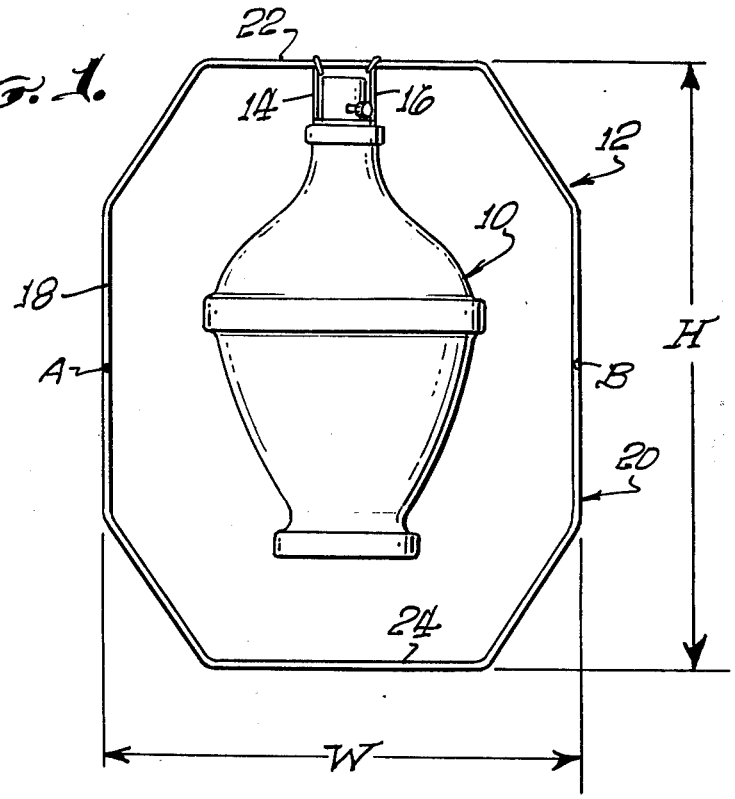
FIG. 1 is a plan view of a fragile lamp body suspended within a wire frame in accordance with the present invention.

Referring now to the drawings, and more particularly to FIG. 1, there is shown an exemplary fragile article such as the lamp body 10 substantially centrally suspended from an essentially rigid frame 12 by a holding means which may be wires 14 and 16, for example. The type of material selected for the frame 12 and its size and shape is dependent upon the value, fragility, size and weight of the article to be packaged. The frame 12 may be made of wire, pipe, bar stock, plastics, and so forth. The frame 12 must be strong enough to bear the weight of the suspended article, must be able to withstand a certain prescribed hot temperature and must withstand prescribed drop testing. The frame 12 may be triangular, square, rectangular or polygonal, for example. For a fragile lamp weighing approximately 15 pounds, as the lamp body 10 may be, for example, the frame 12 could be made of wire of 1/0 thickness and have an octagonal shape, as shown in FIG. 1. The rigid wire frame 12 may be made in one piece and joined at weld point A or the frame could be made in two pieces and joined at weld points A and B. The eight-sided shape of the frame 12 has been found to provide more than adequate strength to properly suspend fragile articles and to withstand rough handling when in the final package form. The wire may be of the hot-rolled, cold-rolled or galvanized types, for example. Sides 18 and 20 of the frame 12 should be approximately one-half the dimension of the frame height (H) and sides 22 and 24 should be approximately one-half the dimension of the frame width (W). The 1/0 wire size can be readily used for lamp bodies weighing from 10 to 25 pounds. The 1/0 wire size can be used for many lamp configurations of different shapes, sizes and materials. As an example, in the case of a lamp 27 inches high, the lamp would be suspended about 3 inches below the side 22 of a frame such as frame 12. This would leave 5 inches of clearance between the bottom of the lamp and the side 24. If a lamp 27 inches high had as its widest dimension a width of 14 inches and if such a lamp in its final package form, in accordance with this invention, were diagonally positioned in a corrugated cardboard shipping carton having sides 20½ inches wide, there would be 3¼ inches of clearance to the vertical walls of the carton. Therefore, the one wire size of 1/0 could be used for frame material to accommodate lamp bodies that are up to 27 inches high and 14 inches in diameter. This range would involve very many lamp body models for the one wire size of 1/0, whereas a different custom designed package would be required for each lamp body configuration with the prior art packaging methods. In the case of a lamp body weighing 10 pounds or less, it would probably be less than 27 inches high and less than 14 inches in diameter. Such a type of lamp body could be suspended in a frame made of No. 4 wire.

Figure 2:
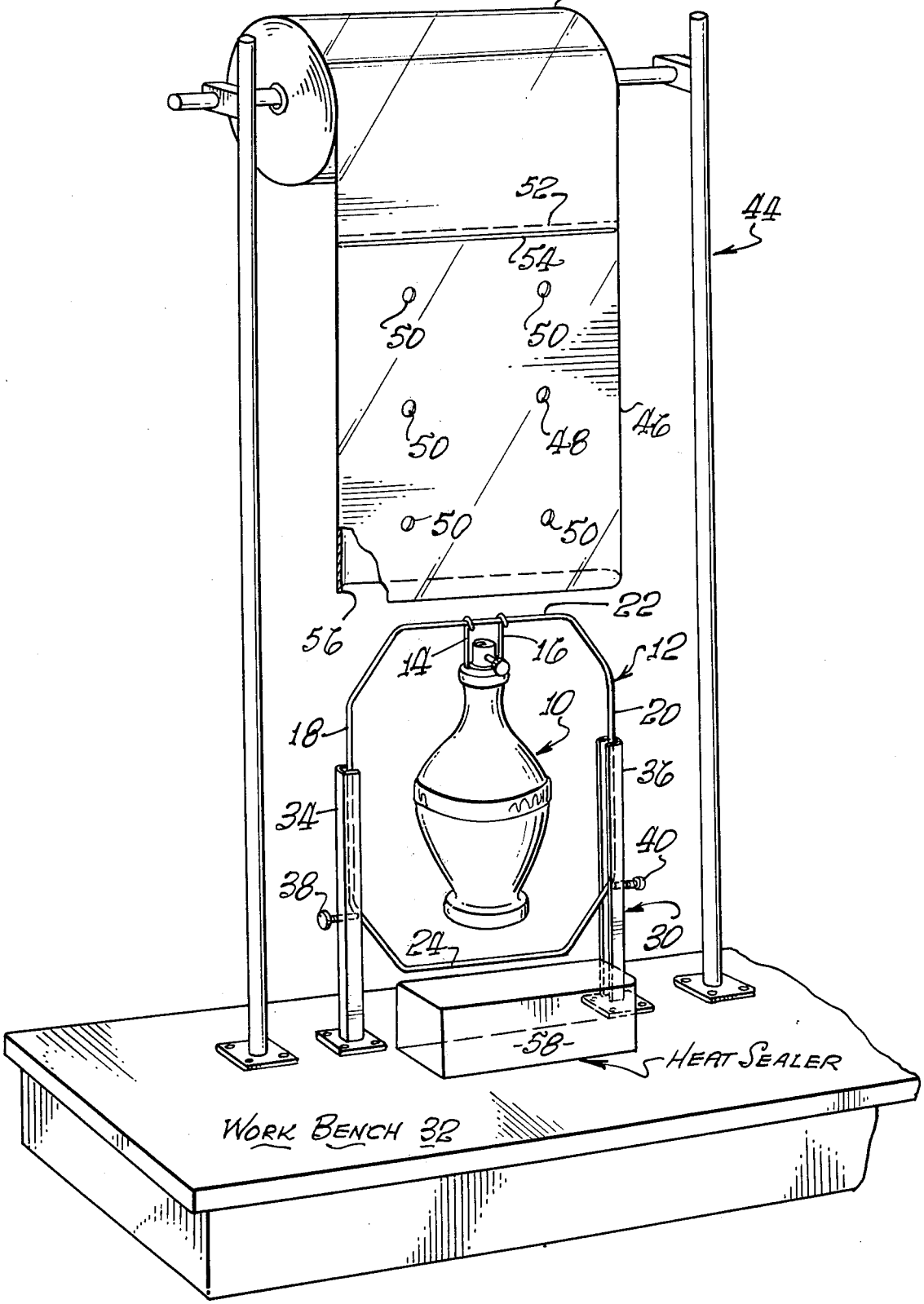
FIG. 2 is a schematic representation of the FIG. 1 assembly positioned with apparatus in accordance with the present invention.

After the lamp body 10 has been suspended in the frame 12, the assembly is positioned in a frame holding fixture 30 which may be mounted on a work bench 32, as shown in FIG. 2. The holding fixture 30 may be made adjustable (not shown) in order to accommodate different frame sizes. Positioned in vertical holding members 34 and 36 in the fixture 30 are stop members 38 and 40, respectively. Stop members 38 and 40 may be screw inserts, for example, or may merely be pins, positioned substantially transverse the vertical holding members 34 and 36, respectively, to prevent the frame 12 from dropping any lower than preset in advance. Mounted over the lamp body 10/frame 12 assembly positioned in the holding fixture 30 is a roll of heat treat-shrinkable sack-like coverings or bags 42 mounted in a holding rack 44 secured to the work bench 32 or held securely in some other fashion. Each of the bags, such as the unrolled bag 46, has at least one through-hole 48 therein and, as further illustrated in FIG. 2, may have a plurality of through-holes 50 therein. Each of the bags, such as the bag 46, has a transverse line of perforations 52 following and end seal 54 to permit the bag 46 to be easily detached from the main roll 42. However, this feature is not mandatory because a cutting device could be used to detach each bag from a roll. In addition, the roll 42 could be replaced by a supply of individual bags, for example, which could be kept in a convenient, accessible dispenser (not shown). Each bag 46 has an opening 56.

The heat treat-shrinkable sack-like coverings or bags are preferably made of materials such as polyethylene, polypropylene, polyesters, polyvinyl chloride, polyvinylidene chloride or polystyrene, for example. With these types of heat shrink materials, orientation in direction and amount and variations in heat temperature setting can provide almost any degree of heat-shrinkage desired. The choice of material depends on various factors such as cost, strength, degree of transparency desired, and availability. Some of these materials shrink upon being subjected to heat, while others shrink during cooling after being subjected to heat. One popular material which may be used as the bag material is polyethylene film. This film is one which shrinks during cooling after being subjected to heat. Polyethylene has good tensile, tear and impact strength and is highly resistant to inorganic chemicals, acids, and alkalies. In addition, polyethylene has low moisture permeability, has good flexibility under extreme cold temperatures, and is easily available at a relatively low cost. If it is desired, the bags such as those made with polyethylene may be specially ordered from the manufacturers to have selected shrink factors for particular requirements. It is understood that separate pieces of heat-shrinkable wrapping material could be fitted and fastened or sealed around the lamp body 10/frame 12 assembly, in lieu of sack-like coverings or bags.

A heat treat-shrinkable wrapping or covering, such as the bag 46, is drawn over the lamp body 10/frame 12 assembly and the frame holding fixture 30 substantially to the base area of the fixture 30. The end portions of the bag 46 near the opening 56 are compressed together and inserted for heat-sealing into a heat sealer 58 mounted on the work bench 32 below and near the bottom of the frame 12 for ease of operation. The heat sealer may be an impulse sealer which is well-known to those skilled in the art and which may be time-sequenced for the fastest and most efficient production. The impulse sealer is considered by persons skilled in the packaging field to be superior for sealing polyethylene film, for example. The choice of heat sealer would be dependent upon the type of bag material used, speed of operation desired, and so forth.

Figure 3:
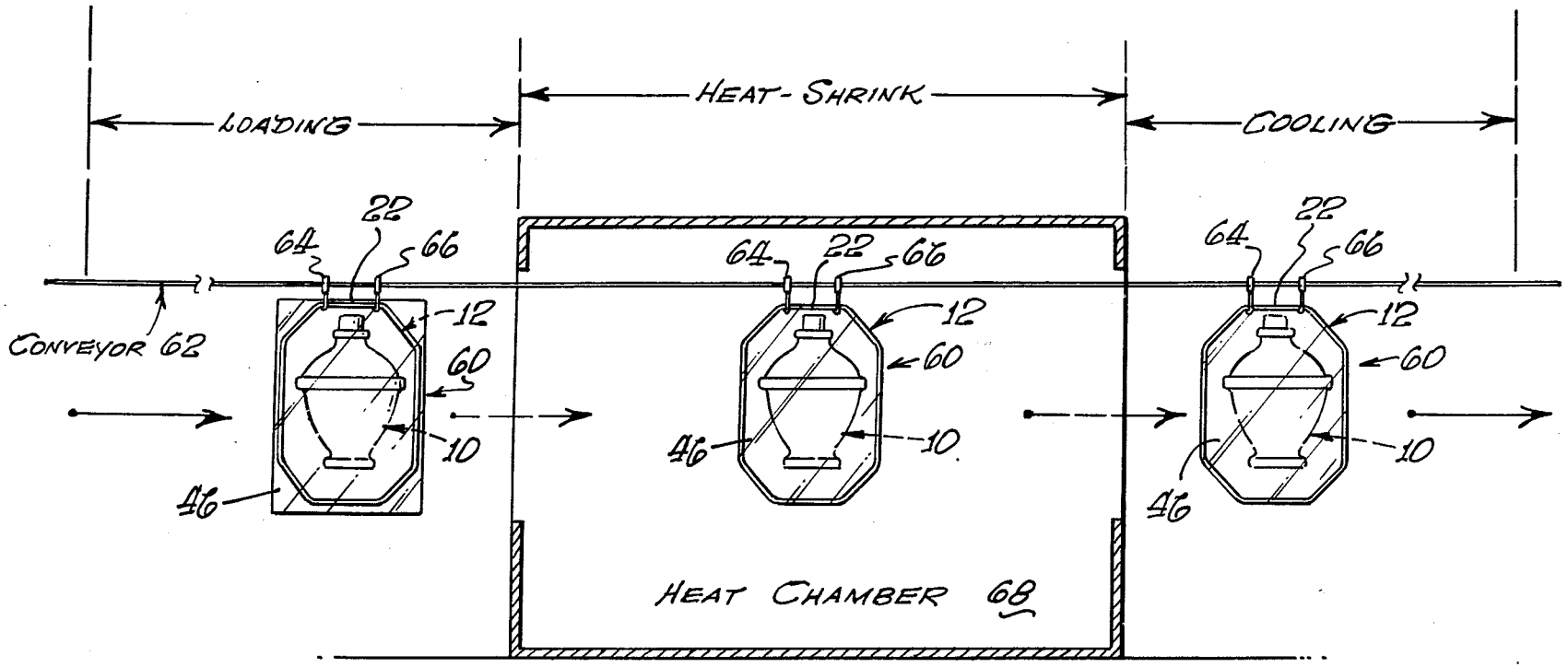
FIG. 3 is a flow sheet showing further procedures employed in forming shock-resistant packages in accordance with the invention, including plan views of the FIG. 1 assembly at various stages.

Upon completion of the heat-sealing step the resulting package assembly 60 is lifted up and out of the holding fixture 30 and is suspended on a conveyor system 62 by hooks 64 and 66, for example, as shown in FIG. 3. The hooks 64 and 66, which may be permanent elements of the conveyor system 62, are forced through the bag under the side 22 of the frame 12. The unsealed portions of the opening 56 of the bag 46 resulting from the sides of the bag 46 being around the vertical holding members 34 and 36 may or may not be also heat-sealed, depending upon the diameter of the holding members 34 and 36. The thickness of the members 34 and 36 would determine if the resultant small openings at the sides of the bag 46 were of any consequence in the remaining procedure. After the package 60 together with similar packages for a production run are loaded on the conveyor 62 by way of suspension devices such as the hooks 64 and 66, the conveyor is started in motion by prime mover means (not shown). The conveyor 62 moves the load of packages through a heat chamber or tunnel 68 whereupon the bag 46 material is heated. As the packages leave the heat tunnel on the conveyor and encounter cooler air the polyethylene bags 46 shrink tightly around the frames 12 and portions of the lamp bodies 10, as shown in FIG. 3, forming taut, but elastic skins or films, under shrink tension, holding the lamps 10 suspended in position within the frames 12. The prime mover for the conveyor 62 would preferably be adjustable to adjust the conveyor's speed through the heat chamber 68, as appropriate, for the type and gage of bag material being used. For example, for a 15 pound lamp body an 8 mil shrink polyethylene bag may be used. The heat chamber 68 may be of an uncomplicated type having heating elements which are quartz tubes in the upper infrared range and which are adjustable by a thermostat or a rheostat to control the amount of heat desired. In the case of the aforementioned 8 mil polyethylene bag material, the heat in the chamber 68 is adjusted to approximately 350° F to 400° F and the speed of the conveyor 62 is adjusted to approximately 18 feet per minute to properly heat that bag material in a tunnel 6 feet long. During the heat and cooling steps, all hot air escapes from the bags via apertures such as the through-holes 48 and 50 shown in FIG. 2. The through-holes remain stable and do not affect the strength of the package.

Figure 4:
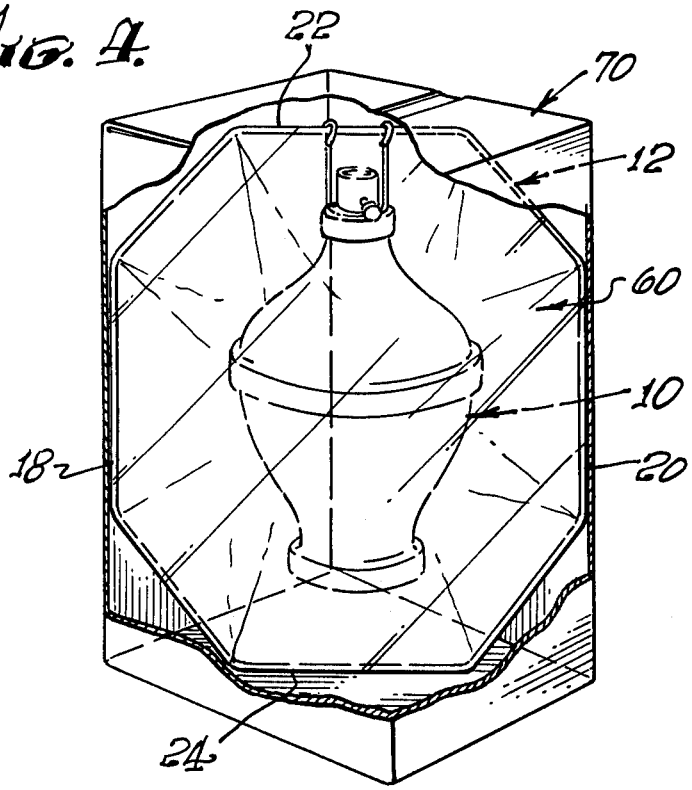
FIG. 4 is a plan view of the FIG. 1 assembly packaged and arranged in accordance with the invention in a box container which is shown in perspective and partially cut away for clarity.

After the package 60 has cooled, it may be enclosed in an appropriate container such as a box 70, as shown in FIG. 4. As illustrated, the package 60 may be positioned diagonally such that sides 18 and 20 of the frame 12 are in contact with and retained by the corners of the box 70 and such that the sides 22 and 24 of the frame 12 are in contact with and retained by the top and bottom, respectively, of the box 70; or the package 60 could be substantially centrally positioned in the box 70 and held in place therein by fasteners and support devices (not shown) which would be affixed to the box 70 as appropriate. After closure of the box 70 is completed, the fragile article therein is ready for handling, shipping or storage. The fragile article 10 is protected from shocks because of the interaction of the frame 12 with the elasticity of the material of the bag 46 and because the fragile article does not contact the inner surfaces of the box 70. Any shock effects impinging on any of the eight sides of the frame 12 are counteracted by the two sides which are at an angle of 90° to the side affected. For example, if the box 70 were dropped such that the side 24 were the impact point, the resulting pressure on the side 24 would be counteracted by the sides 18 and 20. As the side 24 attempts to move inwardly, the sides 18 and 20 move outwardly and the resulting strain causes the heat-shrunken bag 46 to pull in on the sides 18 and 20. Along with this containment factor, the vertical corners of the box 70 in contact with the sides 18 and 20 also assist in restraining the outward movement of the sides 18 and 20. Consequently, it can easily be seen that the effects of direct shocks are effectively minimized or neutralized by the present invention.

It should be noted that there are a variety of methods for placing the shrink bags over the frames and fragile articles suspended therein. For example, the frames with fragile items could be loaded on a conveyor without bags and while so hung the bags could be slipped over the frames from the bottom of the frames, instead of the top.

Further, if one desires, where the temperature of the heat tunnel and speed of conveyor is such that the open end of a bag will be sealed merely by the heat experienced in the tunnel, then the use of a separate sealer, such as heat sealer 58 in FIG. 2, can be eliminated. In this method, the bags could be pulled over the frames from the bottom of the frames, and the open end of the bags folded over the top of the frame would be sealed by the heat in the tunnel. Conveyor hooks 64 and 66, such as shown in FIG. 3, can be punched through the flap of the bag to hold the flap together for sealing of the bag by tunnel heat.

It should be remembered, however, that a shipper may desire to ship fragile items that will not withstand tunnel heat needed for bag sealing, in which case the independent heat sealer will be needed, such as the heat sealer 58 shown in FIG. 2.

In addition, it is to be noted that more than one fragile item can be sealed in a frame and bag, and the frame can be turned sideways and the fragile item or items suspended from a side of the frame, such as side 18 or 20 shown in FIG. 1.

Although specific embodiments of the present invention have been described and illustrated, it is to be understood that the same are by way of illustration and example, and are not intended as limitations of the present invention, the delineation of which is the purpose of the following claims.

I claim:

1. In combination:

a box having a rectangular shape;

a shock-resistant protective package in said box suspending at least one fragile article out of contact with said box, said protective package neutralizing direct shock transfer to the fragile article, said protective package including:

a substantially thin continuous rod-like shock-resistant frame member completely surrounding said fragile article, said rod being small in that cross-sectional dimension taken transverse the longitudinal axis thereof as compared to said fragile article;

means supporting said fragile article in all directions inwardly of said frame member including a wrapping of heat treat-shrunken material having at least one aperture therein for the passage of air therethrough, said wrapping tightly covering the entire perimeter of said frame member and extending inwardly therefrom into contact with said fragile article, said wrapping being in firm physical contact with said frame member and with said fragile article; and said protective package enclosed within said box, said wrapped frame member of said protective package being diagonally disposed within said box and thereby held in firm retention against diagonally opposed corners of said box whereby said wrapped fragile article is prevented from contacting the inner surfaces of said box.

2. The combination of claim 1, wherein said frame member is made of wire.

3. The combination of claim 1, wherein said wrapping of heat treat-shrunken material is polyethylene film.

4. The method of packaging a fragile article in a shock-resistant protective package to neutralize direct shock transfer to the fragile article, said method comprising the steps of:

assembling a substantially thin continuous shock-resistant rod-like frame member, said rod being small in that cross-sectional dimension taken transverse the longitudinal axis thereof as compared to said fragile article;

suspending a fragile article within said frame member, said fragile article suspended with all sides thereof in spaced relationship with said frame member;

completely enclosing said frame member and said fragile article in a heat treat-shrinkable material, said material having at least one aperture therein for the passage of air therethrough;

heating said completely enclosed frame member and fragile article;

cooling said completely enclosed frame member and fragile article, whereby said material is heat shrunk tightly around said frame member and aid fragile article;

providing a carton having a rectangular shape;

placing said protective package with said fragile article therein in said carton with said frame member disposed in diagonally opposed corners thereof and with said fragile article displaced from all surfaces of said carton; and sealing said carton.

5. The method defined in claim 4, additionally including the step of sealing said heat treat-shrinkable material prior to said heat treat-shrinking step.

6. The method defined in claim 4 wherein said heat treat-shrinkable material comprises a material selected from the group consisting of polyethylene, polypropylene, polyesters, polyvinyl chloride, polyvinylidene chloride and polystyrene.

7. The method defined in claim 4, wherein said frame member is made of wire and said heat treat-shrinkable material is polyethylene film.

* * * * *